US009339131B1

(12) United States Patent
Christianson

(10) Patent No.: US 9,339,131 B1
(45) Date of Patent: May 17, 2016

(54) FOOD SHIELD

(71) Applicant: Metal Masters Foodservice Equipment Company, Inc., Clayton, DE (US)

(72) Inventor: Kenneth Shawn Christianson, Clayton, DE (US)

(73) Assignee: Metal Masters Foodservice Equipment Company, Inc., Clayton, DE (US)

( * ) Notice: Subject to any disclaimer, the term of this patent is extended or adjusted under 35 U.S.C. 154(b) by 0 days.

(21) Appl. No.: 14/747,204

(22) Filed: Jun. 23, 2015

Related U.S. Application Data

(63) Continuation-in-part of application No. 14/677,232, filed on Apr. 2, 2015.

(51) Int. Cl.
*A47F 9/00* (2006.01)
*A47F 10/06* (2006.01)
*A47F 3/00* (2006.01)

(52) U.S. Cl.
CPC ..... *A47F 10/06* (2013.01); *A47F 3/007* (2013.01); *A47F 2003/008* (2013.01); *A47F 2010/065* (2013.01)

(58) Field of Classification Search
CPC ..... A47F 2010/065; A47F 3/12; A47F 3/005; A47F 3/007; A47F 23/06; A47F 10/06; A47F 2003/008; A47B 57/54; A47B 96/02; F16B 9/023; E06B 3/5454; E06B 1/38
USPC ..... 312/137, 265.5, 265.6
See application file for complete search history.

(56) References Cited

U.S. PATENT DOCUMENTS

| | | | |
|---|---|---|---|
| 384,784 | A | 6/1888 | Pihl |
| 959,099 | A | 5/1910 | Anderson |
| 1,231,635 | A | 7/1917 | Nelson |
| 1,244,855 | A | 10/1917 | Hess |
| 1,353,552 | A | 9/1920 | Sweet |
| 1,358,262 | A | 11/1920 | Sumner |
| 1,779,236 | A | 10/1930 | Hoegger |
| 2,163,859 | A | 6/1939 | Ver Bockel |

(Continued)

OTHER PUBLICATIONS

Office Action issued Nov. 6, 2015 in U.S. Appl. No. 14/677,232 for McAllister.

(Continued)

*Primary Examiner* — Daniel J Troy
*Assistant Examiner* — Timothy M Ayres
(74) *Attorney, Agent, or Firm* — Panitch Schwarze Belisario & Nadel LLP

(57) ABSTRACT

A food shield has shield panels that are location adjustable and angularly adjustable in respect of support structures (posts) that are coupled to a mounting surface, such as a surface of a buffet table or cart. For location adjustment of a shield panel along length of a post, a bracket assembly includes outer and inner collar portions, a grip element positioned between the outer and inner collar portions, and a tightening element that tightens the connection of the assembled collar against support posts. For angular adjustment, each bracket assembly includes an indexing base, a rotatable arm assembly with an indexing hub, and a removable or retractable coupling element. Side panels are mounted to the same posts as the shield panels with removable clamps that engage exterior surfaces of the posts. The removable clamps have multiple parts that are variously inverted for joining the clamps to posts at different orientations.

10 Claims, 12 Drawing Sheets

(56) References Cited

U.S. PATENT DOCUMENTS

| | | | | |
|---|---|---|---|---|
| 3,003,813 | A * | 10/1961 | Bolenbach | B60J 3/0208 248/279.1 |
| 3,026,162 | A | 3/1962 | Waszkiewicz | |
| 3,500,594 | A | 3/1970 | O'Brien | |
| 3,610,562 | A * | 10/1971 | Holmes | G09F 7/20 211/169.1 |
| 4,799,818 | A | 1/1989 | Sudimak et al. | |
| 5,199,680 | A | 4/1993 | Rivera | |
| 5,259,581 | A | 11/1993 | Goldberg | |
| 5,351,927 | A | 10/1994 | Howell | |
| 5,584,545 | A | 12/1996 | LaVaute et al. | |
| D377,429 | S | 1/1997 | Olson | |
| 6,132,018 | A | 10/2000 | McGrath | |
| 6,485,118 | B2 | 11/2002 | Matus, Jr. | |
| 6,588,863 | B1 | 7/2003 | Yatchak et al. | |
| 7,040,723 | B2 | 5/2006 | Matus, Jr. | |
| 7,155,869 | B2 | 1/2007 | Wildenhain et al. | |
| D543,740 | S | 6/2007 | Hartsfield, Jr. et al. | |
| D575,560 | S | 8/2008 | English | |
| D610,373 | S | 2/2010 | Matus, Jr. | |
| D610,374 | S | 2/2010 | Matus, Jr. | |
| D613,971 | S | 4/2010 | Matus, Jr. | |
| 7,895,953 | B2 | 3/2011 | Matus, Jr. | |
| 8,109,579 | B2 | 2/2012 | English et al. | |
| 8,308,249 | B2 | 11/2012 | Matus, Jr. | |
| 8,403,430 | B2 | 3/2013 | Atkins | |
| 8,585,160 | B2 | 11/2013 | Atkins | |
| 2001/0023562 | A1 | 9/2001 | Blobaum et al. | |
| 2003/0057810 | A1 | 3/2003 | DeWitt | |
| 2006/0163976 | A1 | 7/2006 | Matus | |
| 2006/0284522 | A1 * | 12/2006 | Burke | A47F 3/12 312/116 |
| 2007/0236112 | A1 * | 10/2007 | Williman | A47F 3/12 312/140.4 |
| 2008/0092464 | A1 | 4/2008 | Haab et al. | |
| 2010/0045149 | A1 * | 2/2010 | English | A47B 96/062 312/140.4 |
| 2011/0080075 | A1 * | 4/2011 | Matus, Jr. | A47F 3/007 312/140.4 |
| 2011/0169384 | A1 * | 7/2011 | Padden | A47F 10/06 312/140.4 |
| 2011/0193453 | A1 * | 8/2011 | Matus, Jr. | A47F 10/06 312/140.4 |
| 2012/0200207 | A1 * | 8/2012 | Atkins | A47F 10/06 312/137 |

OTHER PUBLICATIONS

Office Action issued Jul. 9, 2015 in U.S. Appl. No. 14/677,232 for McAllister.

* cited by examiner

FOOD SHIELD

CROSS-REFERENCE TO RELATED APPLICATION

This application is a continuation in part from U.S. patent application Ser. No. 14/677,232, filed Apr. 2, 2015, status pending.

BACKGROUND

The present invention relates to food shields, and particularly adjustable food shields positioned over open receptacles and/or containers having food contained therein.

Food shields, also known as sneeze guards, are frequently positioned over open receptacles and/or containers, having food contained therein. Food shields are found in eateries that serve hot and cold food "buffet-style." Such eateries include, but are not limited to, cafeterias, buffet restaurants, restaurants with salad bars, and smorgasbords.

Food shields are used in these types of establishments to protect food from contamination, particularly with respect to bodily fluids and bacteria that may be inadvertently spread as patrons obtain food from a buffet. Food shields also provide patrons with a secure sense that open food containers are protected. As such, most, if not all, cafeterias, restaurants and smorgasbords are required to install food shields to meet standards set by national and local health codes.

Some health codes provide different standards for food shields, depending upon the primary use of the food shield. For example, code standards may be different for shields used for buffets where food service professionals plate food (operator-serviced), as opposed to food shields used for buffets where patrons serve themselves (self-serviced). Manufacturers of food shields offer adjustable food shields, which allow food shields to adapt to either type of primary use.

Food shields also are used by eateries to provide aesthetic value to buffets. In some instances, food shields may be used as a key design element in buffet presentation such that the food shield design adds to the overall ambiance of a buffet. From a merchandising perspective, some food shields make buffets appear highly professional and present food in a more appetizing, attractive and favorable light.

Various types of food shields are known, including those that provide both adjustable and aesthetic features. Nonetheless, there is still a need for improved food shields that meet or exceed health code requirements, provide improved adjustability, and further lend to the aesthetic value of food presented and served "buffet-style." The present invention fulfills these needs and provides further related advantages, as described herein.

BRIEF SUMMARY

According to one preferred embodiment, an adjustable food shield includes shield panel support structures mounted to and extending from a mounting surface, one or more shield panels positioned between at least two support structures, and a plurality of adjustment bracket assemblies coupled to each support structure for adjustment of the shield panels. Each shield panel support structure includes posts or legs coupled to a countertop surface of a buffet table or cart. Each shield panel preferably comprises a semi-transparent or transparent material. A shield panel may be position adjusted and/or angularly adjusted between the shield panel support structures using various elements of the adjustment bracket assemblies.

For position adjustment of a shield panel along the length of the support structure or post, each bracket assembly includes a collar having an outer collar portion, an inner collar portion, a grip element positioned at least partially between the outer and inner collar portions, and a tightening element that tightens the connection of the collar against posts of the shield panel support structure. For angular adjustment, each bracket assembly includes an indexing base, a rotatable arm assembly with an indexing hub, and a removable or retractable coupling element such as a pin, screw, or rod. The rotatable arm assembly via the indexing hub rotates with respect to an axle bolt axis and the outer collar portion includes a series of holes, slots or recesses spaced apart in an array such that the removable or retractable coupling element engages with a respective hole, slot or recess of the indexing hub. Each bracket assembly also includes a panel slide rod having panel holding clamps at each end, with each panel holding clamp fastening onto an outer edge of a shield panel. For improved aesthetics and improved coupling of the panel holding clamp to the shield panel, the shield panel preferably include semi-opaque surfaces at the shield panel ends.

In addition, a side panel is removably coupled to one of the support structures or posts that support the shield panel. The side panel is held by two or more removable collar clamps that engage exterior surfaces of the support structures or posts at locations other than where the bracket assembly is joined to the support structure or post. The removable collar clamps each define a slot with slot faces that engage the first face surface and opposite face surface of the side panel, and with curved inner surfaces that engage around at least a portion of the post. The removable collar clamps may comprise multiple components held together by fasteners, and the components may be assembled together in one orientation to secure the clamp to a vertical extending post, another orientation to secure the clamp to a vertical extending post at a different location about the outer circumference of the post, and yet another orientation to secure the clamp to a horizontal extending post. At least two of the component pieces of the collar clamp may be rotated or inverted to be joined together in the alternate orientations. In the various orientations, the slot opening may be directed differently to grip a bottom edge, a top edge or a side edge of the side panel, as desired.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
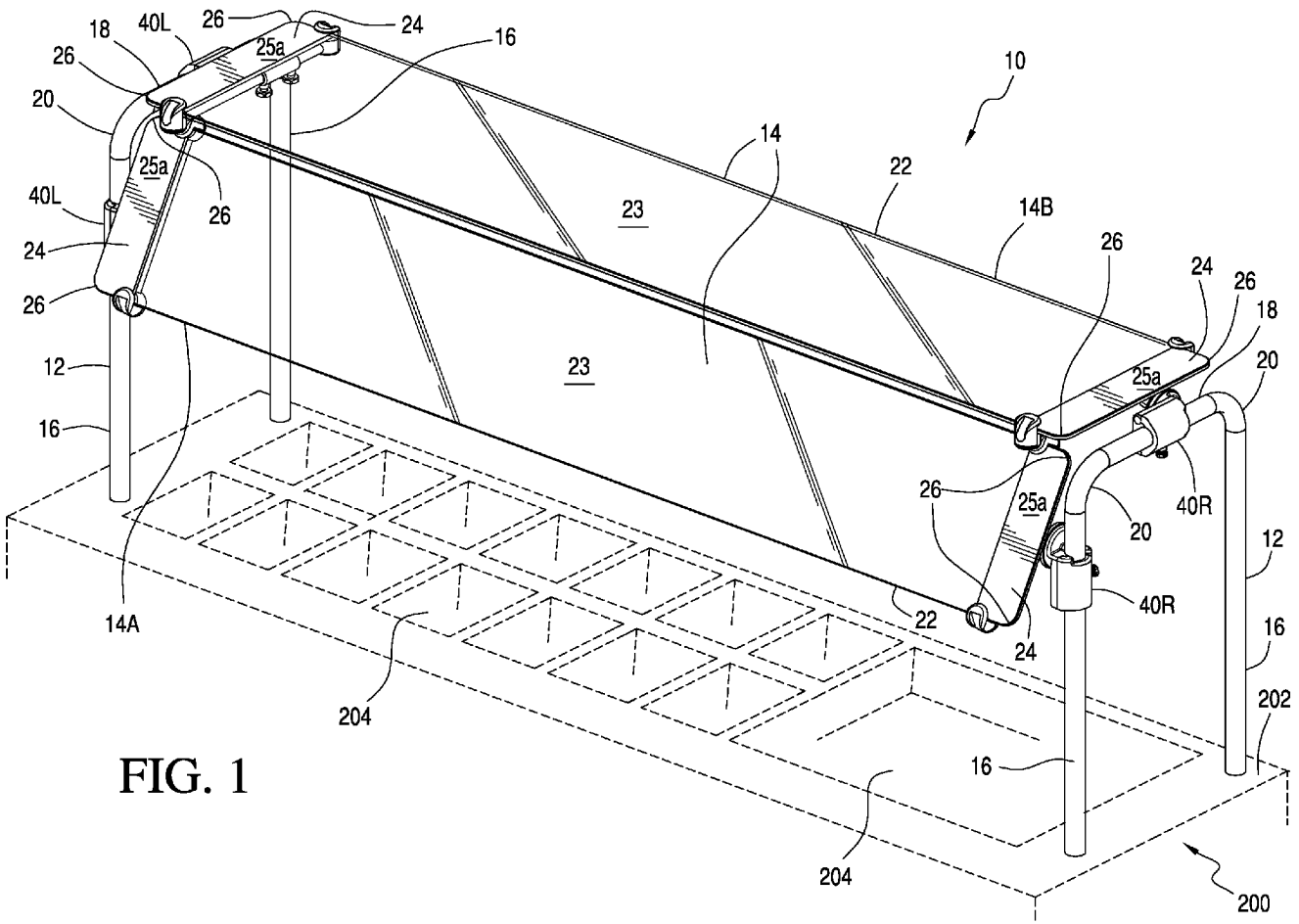
FIG. 1 is a right front perspective view of a food shield in accordance with an embodiment of the invention.

Reference will now be made in detail to the present embodiment of the invention illustrated in the accompanying drawings. The same or like reference numbers may be used in the drawings to refer to the same or like features. It should be noted that the drawings are in simplified form and not drawn to a precise scale.

In reference to the disclosure herein, for purposes of convenience and clarity only, directional terms such as top, bottom, above, below, front, rear, right, left, inner, and outer, are used with respect to the accompanying drawings. Such directional terms used in conjunction with the following description of the drawings should not be construed to limit the scope of the invention in any manner not explicitly set forth herein. Unless specifically set forth herein, the terms "a", "an" and "the" are not limited to one element but instead should be read as meaning "at least one". The terminology includes the words noted above, derivatives thereof and words of similar import.

Turning in detail to the drawings, FIG. 1 shows one embodiment of a food shield 10, including two shield panel support structures 12, two shield panels 14 (with a front shield panel 14A being angularly positioned with respect to a food serving structure 200 and a top shield panel 14B being laterally positioned with respect to the food serving structure 200), extending between the two shield panel support structures 12, and a plurality of adjustment bracket assemblies 40L (positioned on the left side of the food serving structure 200), 40R (positioned on the right side of the food serving structure 200) (generally 40) used for both height or vertical adjustment and angular adjustment of at least one shield panel 14. The shield panel support structures 12 are mounted to and extend upwardly from a food serving structure 200, such as a buffet, cart or table with a mounting surface 202 suitable for serving food (not shown). Such food serving structures 200 may include food receiving receptacles 204 of various sizes, contained within the food serving structure 200. Other types of receptacles (not shown) may also be positioned above the mounting surface 202 and under the food shield.

Each shield panel support structure 12 preferably is configured to have a substantially u-shape. Shield panel support structures may, however, be provided in other shape configurations. Other shape configurations include, but are not limited to a singular and substantially vertical post and 1-shaped, pentagonal, trapezoidal, or other polygonal shape configurations. When configured to have a substantially u-shape, each support structure 12 preferably includes side posts 16 and a bridge element 18, extending above the food serving structure 200 and between the side posts 16. Bend elements 20 are preferably positioned and coupled to side posts 16 and the bridge element 18. The support structure 12 may further include connection elements (e.g. screws and/or mounting plates, not shown) that facilitate connection to the food serving structure 200, which are positioned below the food serving structure 200.

Each support structure 12 and its respective elements 16, 18, 20 preferably are manufactured from non-oxidizing metallic-based or aluminum-based materials. Support structures 12 may be manufactured as a unitary piece, or the support structure elements 16, 18, 20 may be connected together via mechanical (e.g., complementary threads or welding) or chemical (e.g., adhesives) methods. Support structure elements 16, 18, 20 preferably are manufactured from hollow rod materials with a substantially circular cross-section (See, e.g., FIGS. 9 and 10).

Figure 4:
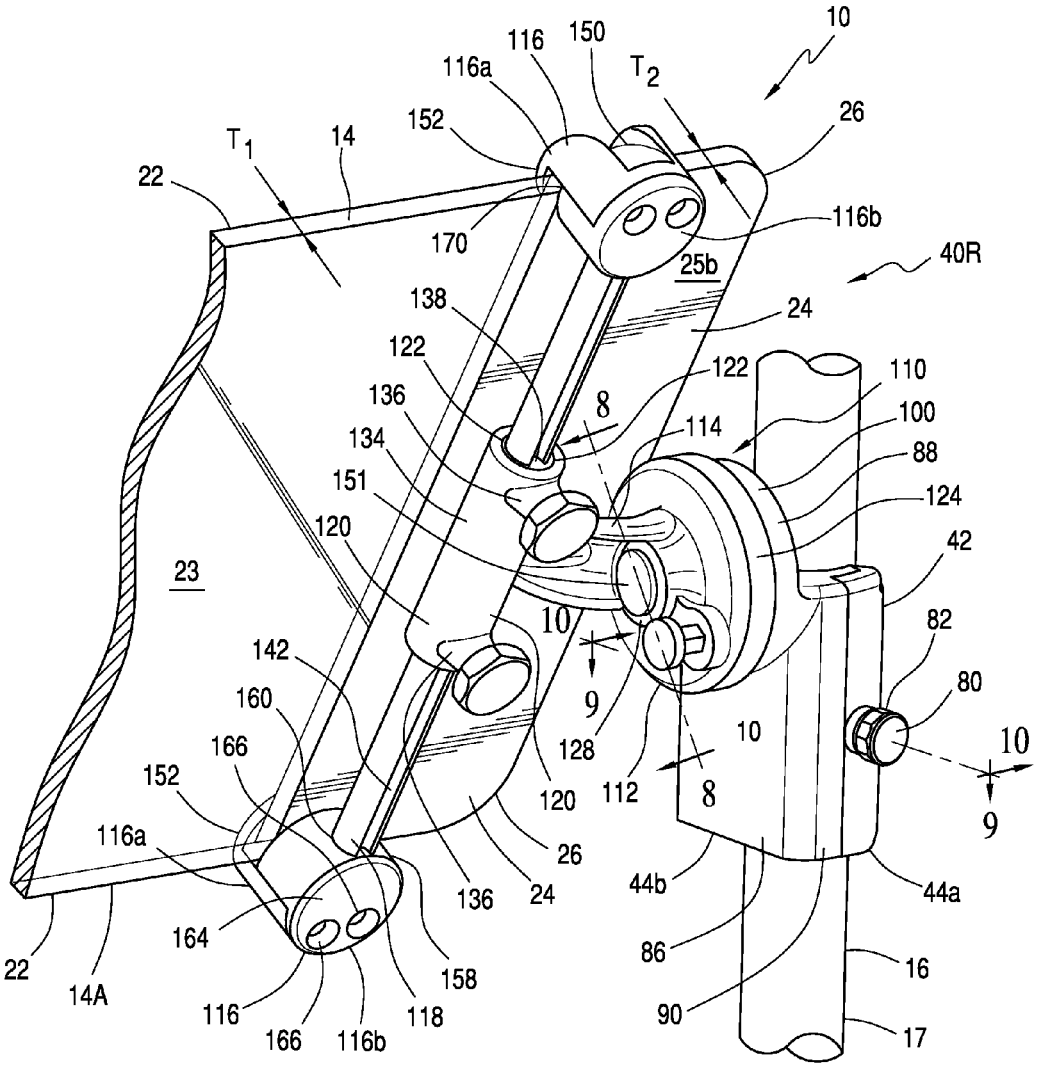
FIG. 4 is an enlarged partial section of a rear perspective view of the food shield shown in FIG. 1.

Upon assembly, the food shield 10 preferably includes one front shield panel 14A coupled to the support structure 12 for angular and vertical or height adjustment, and one top panel 14B laterally positioned laterally above the receptacles 204 of the food serving structure 200 for angular and/or location adjustment. Each shield panel 14 has a panel body 22 with a substantially rectangular configuration. Preferably the panel body 22 includes a transparent or substantially transparent central section 23, semi-opaque or opaque end sections 24, and rounded edges 26. Each shield panel 14 also preferably has a substantially uniform thickness $T_1$ (FIG. 4) along at least the length of the substantially transparent central portion.

Where a shield panel 14 includes semi-opaque or opaque end sections 24, the end sections 24 may be applied with a frosted or semi-opaque element. The frosted or semi-opaque element may be applied as a coating or film on the upper and lower surfaces 25*a*, 25*b* of the end sections 24 such that each end section 24 is provided with a thickness T2 (FIG. 4). Materials used for the frosted or semi-opaque elements 30 include, but are not limited to synthetic resins or other plastic materials manufactured in whole or in part from polyvinyl chloride or related polymer. Alternatively, the opaque or opaque end sections 24 may result from mechanically or chemically altering the shield panel material. Such altering may occur my sandblasting or etching shield panel materials. Shield panel materials include, but are not limited to, glass, acrylic, and PLEXIGLAS® sheet materials, and particularly sheet materials manufactured for durability within food service environments.

Shield panels 14 may be manufactured in various lengths. Standard lengths typically have a minimum length of about 8" (inches) and a maximum length of about 8' (feet). Standard thicknesses typically are a minimum thickness of about 0.25" (inches) and a maximum thickness of about 0.5" (inches).

As shown particularly in FIGS. 2, 3, 6, and 7, shield panels 14A, 14B are coupled to adjustable bracket assemblies 40L, 40R. Preferably, end sections 24 of each shield panel 14A, 14B are coupled to each adjustable bracket assembly 40L, 40R, as shown particularly in FIG. 1. Each adjustable bracket assembly 40L, 40R includes elements that couple to side posts 16 of respective shield panel support structures 12 for height or vertical position adjustment with respect to side posts 16 and angular adjustment with respect to each shield panel 14.

Figures 6, 7:
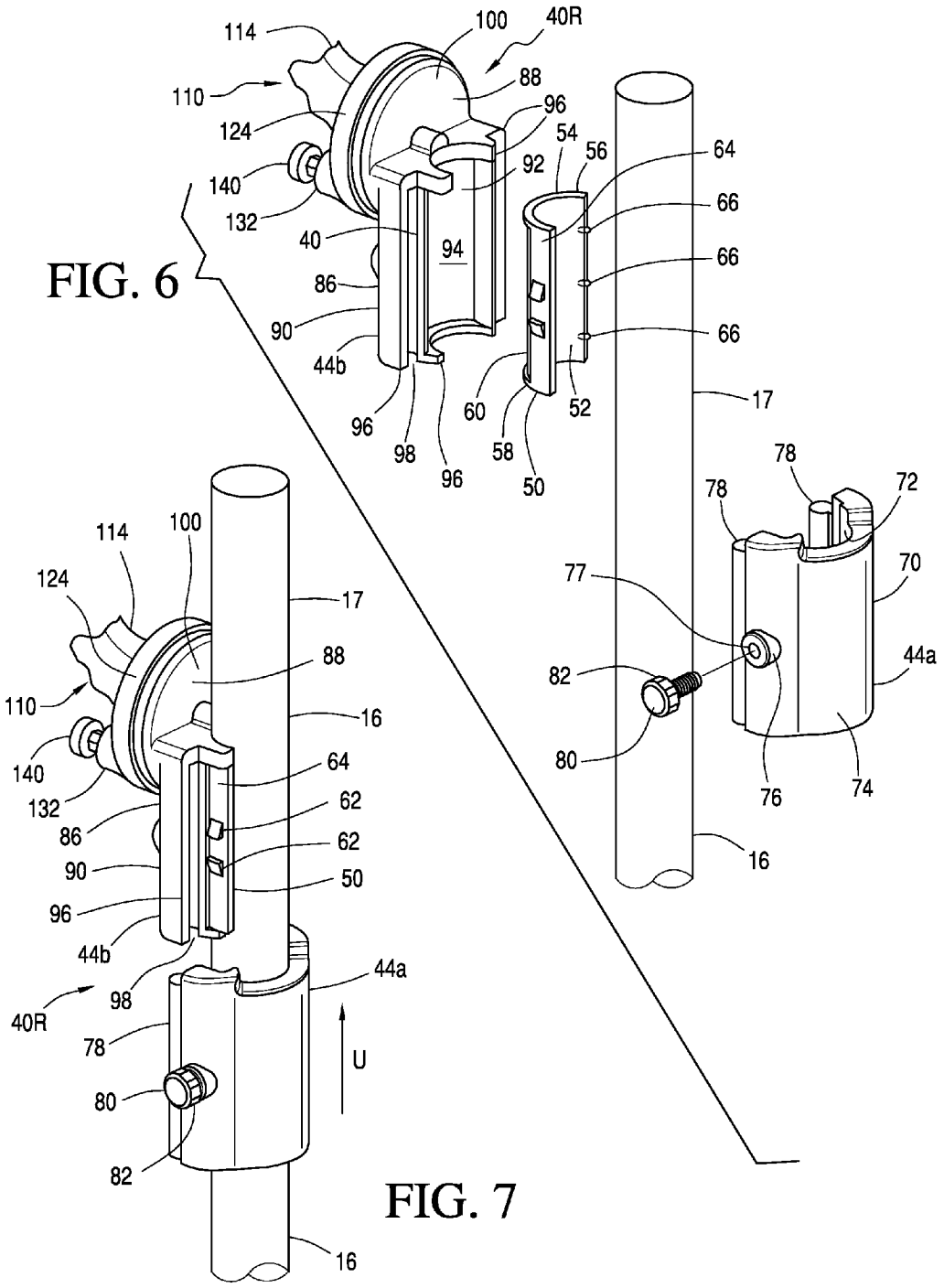
FIG. 6 is a partially exploded right perspective view of a portion of a bracket post assembly.
FIG. 7 is a partially assembled right perspective view of the portion of the bracket post assembly shown in FIG. 6.

For purposes of illustration, FIGS. 6 and 7 show perspective views of adjustable bracket assemblies 40R, which are positioned on the right side of the food shield 10 shown in FIG. 1. It should be understood, however, that elements of the adjustment bracket assemblies 40R positioned on the right side of the food shield 10 are mirror images of the adjustment bracket assemblies 40L positioned on the left side of the food shield 10. See FIGS. 2 and 3.

Figure 3:
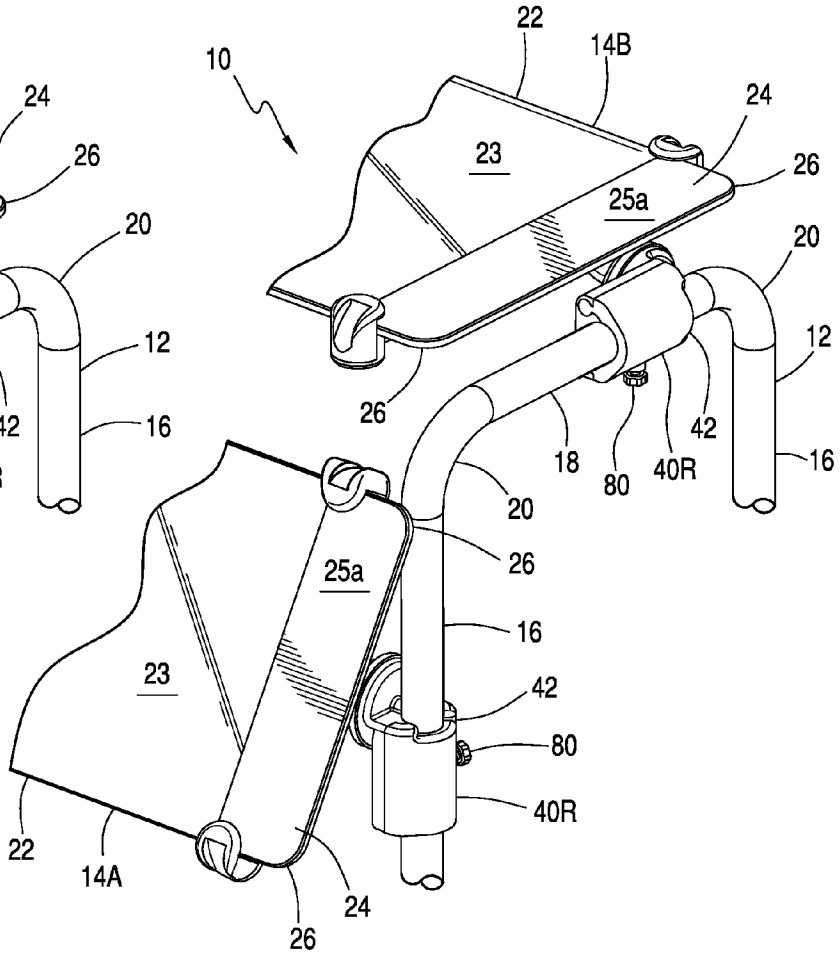
FIG. 3 is a partially exploded view of the enlarged partial section of the food shield shown in FIG. 2.
Figure 2:
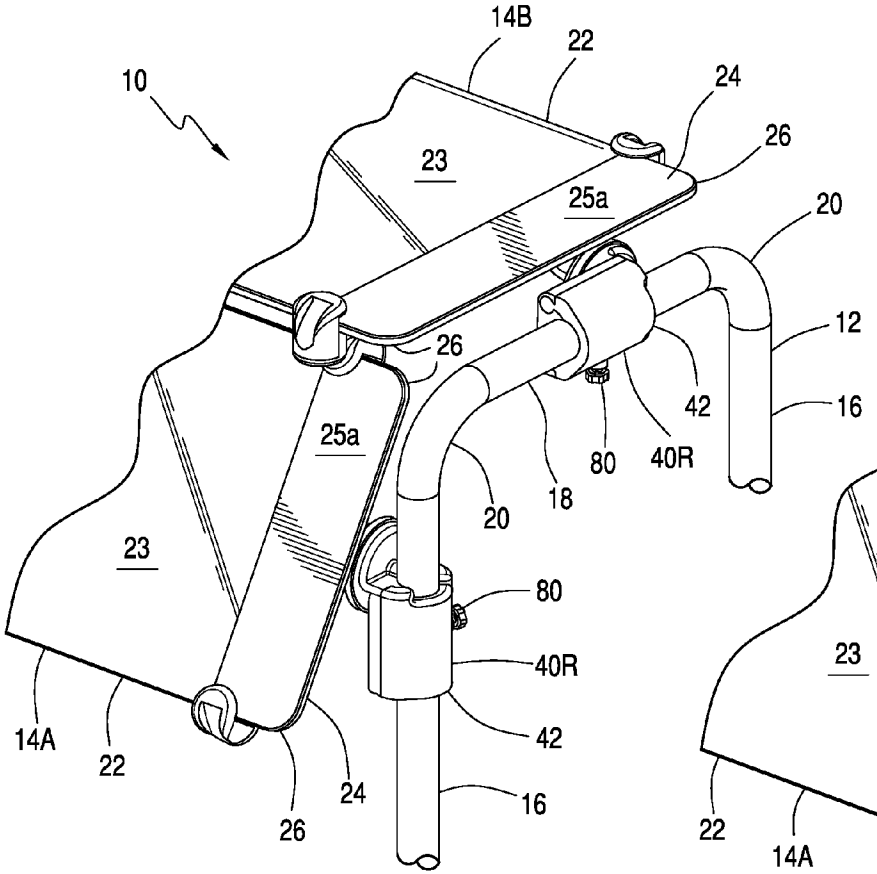
FIG. 2 is an enlarged partial section of the right side of the food shield shown in FIG. 1.

FIGS. 2, 3, 5, 6, 7, and 9, particularly, show various elements of adjustable bracket assemblies 40R that allow for position adjustment. FIG. 2 shows the adjustable bracket assemblies 40R in initial positions with front edges of the panels 14A, 14B closely adjacent or overlapping one another. FIG. 3 shows panels 14A, 14B in second positions after adjustment of each bracket assembly 40R. Specifically, in the second position shield panel 14A has been positioned downward and shield panel 14B has been positioned towards the right of the bridge element 18. In the second positions, the front edges of the panels 14A, 14B are spaced apart from one another.

Each bracket assembly 40R includes a collar 42, having at least two separable collar portions (FIGS. 5, 6, 7, and 9)—an outer collar portion 44*a* and an inner collar portion 44*b*. In addition, a grip element 50 (FIGS. 6, 7, 9, and 10), having an inner surface element 52, also preferably is disposed at least partially within both collar portions 44*a*, 44*b* when the collar 42 is fully assembled (See FIGS. 9 and 10). The inner surface element 52 is provided to enhance the "grip-ability" of the grip element 50 with a side post 16. As used herein, the term "grip-ability" refers to the ability of the inner surface element 52 to improve the frictional resistance of inner surfaces of the grip element with outer surfaces of side posts 16, a bridge element 18, or any other surface to which the adjustable bracket assembly is coupled. Preferably, the inner surface element 52 is an elastomeric material that is overmolded onto the grip element 50 to prevent slippage of the bracket assembly 40R after assembly and prevent sliding adjustment.

Figure 9:
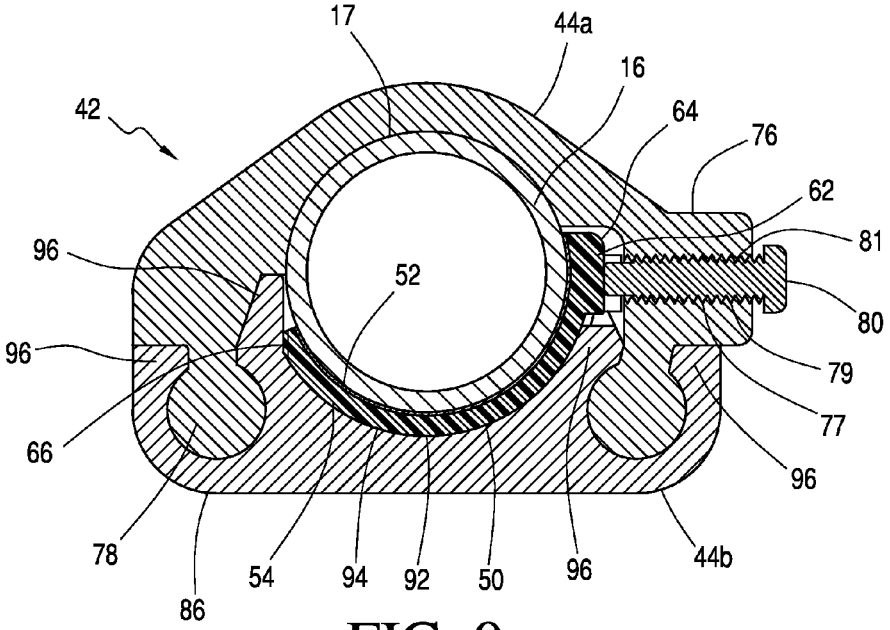
FIG. 9 is a cross-sectional view of the fully assembled bracket post assembly of the food shield shown in FIG. 4, taken along line 9-9 of FIG. 4.
Figure 10:
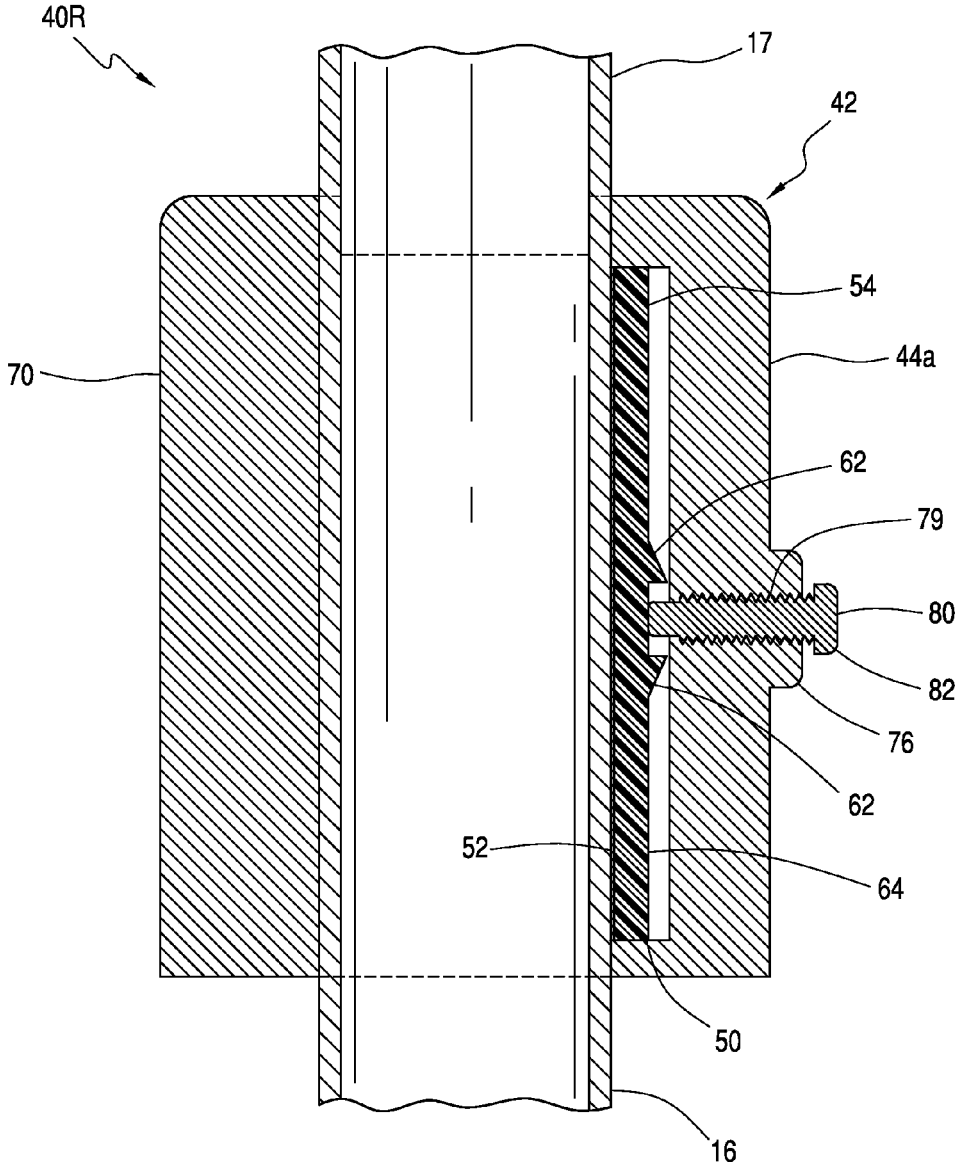
FIG. 10 is a cross-sectional view of the fully assembled bracket post assembly of the food shield, shown in FIG. 4, taken along line 10-10 of FIG. 4.

The grip element 50 is positioned between the outer and inner collar portion 44*a*, 44*b*, as shown particularly in FIGS. 9 and 10, to facilitate coupling of the bracket assembly 40R with a side post 16 of the shield panel support structure 12. Referring particularly to FIGS. 6, 7, 9, and 10, the grip element 50 is shown having an elongated body 54, with upper and lower rims 56, 58 (FIG. 6), an outer recess 60 (FIG. 6), locators 62 positioned on a side face 64 of the body 54, and grip tabs 66 positioned on the opposite side face 68 along the length of the body 54. The upper and lower rims 56, 58 and the outer recess 60 of the grip element 50 are configured to fit within the outer collar portion, as shown in FIG. 7. The side face 64 and locators 62 are positioned outside of the outer collar portion 44*a* for locating a post tightening element 80 when the collar 42 is fully assembled. (See FIGS. 9 and 10). Grip tabs 66 are positioned on the opposite side face 68 of the grip element 50 to further facilitate coupling the grip element 50 upon fully assembly of the collar 42. In this embodiment, the grip element 50 also is provided with an arc-shape, as shown in FIG. 9.

Referring particularly to FIGS. 6, 7, 9 and 10, the outer collar portion 44*a* of the collar 42 includes an elongated outer portion body 70, having an inner contoured surface 72, an outer-facing contoured surface 74, a boss 76 extending from the outer contoured surface 74, a thru-section 77 extending through the body 70 and the boss 76, and male mating elements 78. The inner contoured surface 72 has a semi-circular profile that complements the outer surface 17 of the side post 16. The thru-section 77 includes threads 79 for coupling with a post tightening element 80. The post tightening element 80 preferably is configured as a set screw with threads 81 or a pin, having a grippable end 82 such that rotation of the tightening element 82 causes the body 70 of the collar portion 44*a* to move toward the post 16. As the tightening element 82 moves toward the post 16, the fit between the post 16, the outer collar portion 44*a*, and the post tightening element 82 increases.

The inner collar portion 44*b*, as shown particularly in FIGS. 4-9 includes a location or position adjustment section 86 and an angular adjustment section 88. The location or position adjustment section 86 mates with grip element 50 and the outer collar portion 44*a*. Referring particularly to FIGS. 6 and 9, the adjustment section 86 includes an elongated inner portion body 90, having an inner cavity 92 configured to receive the grip element 50, an inward-facing contoured surface 94, and coupling elements 96 that extend to form female cavities 98 for slidable engagement with male mating elements 78 of the outer collar portion 44*a*. FIG. 7, in particular, shows how male mating elements 78 of the outer collar portion 44*a* slidably engage within female cavities 98 of the inner collar portion 44*b*. Preferably, during assembly the outer collar portion 44*a* is first positioned on a post 16 below the inner collar portion 44*b*. Next, the outer collar portion 44*a* is slidably moved, indicated by an arrow U, shown in FIG. 7, towards the inner collar portion 44*b*. As the outer collar portion is moved in the direction U, male mating elements 78 engage within female cavities 98, coupling the inner and outer collar portions 44*a*, 44*b* together. To secure the position of the collar 42 on its respective post 16 (or alternatively on a bridge element 18), the post tightening element 80 is fitted against the post 16.

Figure 5:
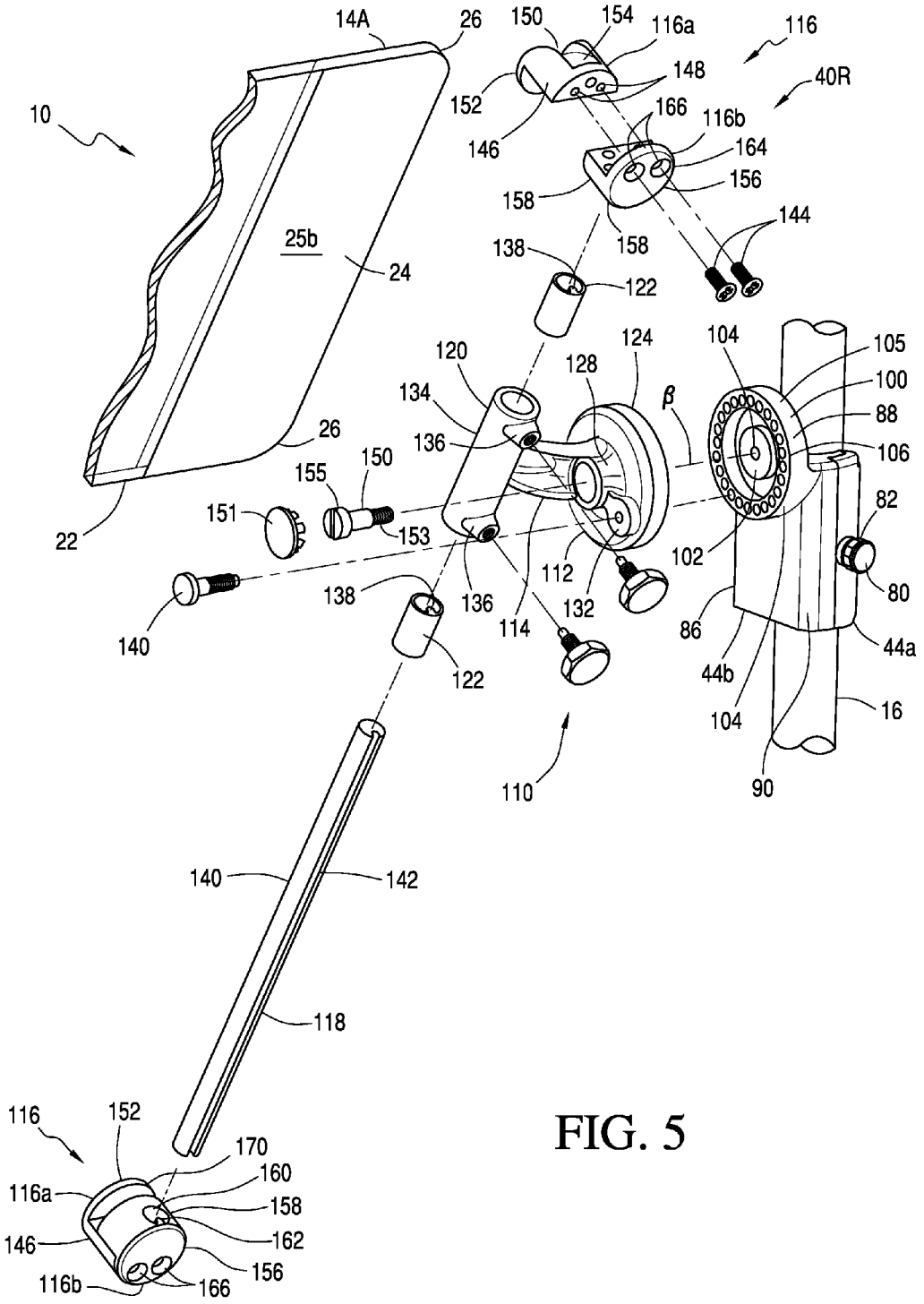
FIG. 5 is an exploded view of the enlarged partial section of the food shield shown in FIG. 4.
Figure 8:
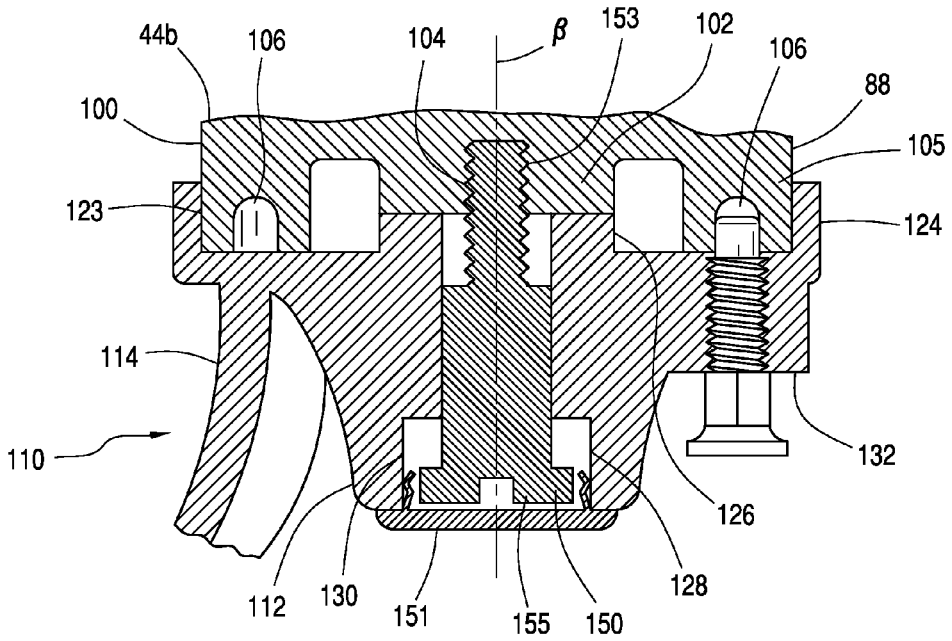
FIG. 8 is a cross-sectional view of the fully assembled bracket post assembly of the food shield shown in FIG. 4, taken along line 8-8 of FIG. 4.

Elements of the adjustable bracket assembly 40R that provide angular adjustment of the shield panel 14A are shown particularly in FIGS. 4, 5 and 8. Such elements include the angular adjustment section 88 of the inner collar portion 44*b* and the rotatable arm assembly 110. Referring particularly to FIGS. 5 and 8, the angular adjustment section 88 of the inner collar portion 44*b* includes an indexing base 100, having a central base portion 102 with an axle bolt receiving hole 104, and an outer base portion 105 with receiving holes, slots or recesses 106. Preferably, the receiving holes, slots or recesses 106 are radially and symmetrically positioned in an array within respect to a base-axle axis β (FIG. 5).

As shown particularly in FIGS. 4, 5 and 8, the rotatable arm assembly 110 includes an indexing hub 112 that couples with the indexing base 100, an extension arm 114 extending from the indexing hub 112, a panel clamp assembly 116, a panel support rod 118, a support rod receiving element 120 coupled to the extension arm 114, and support rod bushings 122 that slidably engage within the support rod receiving element 120. The indexing hub 112 is provided with a bored cavity 123 that mates with the indexing base 100 such that the indexing hub 112 has an outer hub rim 124 positioned around the indexing base 100 upon assembly. The indexing hub 112 also includes a central boss 126 (FIG. 8), an axle bolt boss 128, a counterbored axle bolt hole 130, and a side boss 132 extending from the axle bolt boss 128. The central boss 126, the axle bolt boss 128, and the counterbored axle bolt hole 130 all couple with an axle bolt 150 that mates the rotatable arm assembly 110 with the angular adjustment section 88 of the inner collar portion 44*b*. The axle bolt 150 includes a threaded end 153 received within the axle bolt receiving hole 104 of the central base portion 102. Optionally, an end cap 151 may be coupled to the head 155 of the axle bolt 150 or fastened to axle bolt hole 130. The end cap 151 may include decorative elements (not shown) that further lend to the aesthetic value of the food shield 10.

To rotate the rotatable arm assembly 110, the rotatable arm assembly 110, the axle bolt 150, and the indexing hub 112 are assembled with a clearance fit such that the rotatable arm assembly 110 is able to rotate with respect to base-axle axis 13 (FIG. 5). To lock the rotatable arm assembly 110 in place, a removable or retractable coupling element 140 (e.g., pin, screw, or rod) is positioned within a receiving hole or recess 106. When alternative positioning of the shield panel 14 is desired by a user, the rotatable arm assembly 110 is rotated clockwise or counterclockwise and the removable or retractable coupling element 140 is repositioned and placed in another receiving hole, slot or recess 106. As shown particularly in FIG. 5, the receiving holes, slots or recesses 106 are spaced apart in an array such that the removable coupling element 140 engages with a respective hole, slot or recess of the indexing hub 112, and thereby providing angular adjustment of the shield panel 14/14A.

As shown particularly in FIG. 4, when assembled with the rotatable arm assembly 110, a shield panel 14/14A is supported, in combination, by the panel clamp assembly 116, the panel support rod 118, the support rod receiving element 120, and support rod bushings 122. The support rod receiving element 120 includes a cylindrical body 134 and at least two coupler bosses 136 extending from the cylindrical body 134 having holes 135 for insertion of tightening screws. At least two support rod bushings 122 are preferably positioned within the cylindrical body 134.

Each support rod bushing 122 includes a male coupler 138 that extends inwardly from an inner surface of the bushing 122. The panel support rod 118 has an elongated rod body 140 with a slot 142 having an inner profile complementary to the outer profile of the male coupler 138 such that the slot 142 and the male coupler 138 slidably engage and the outer diameter of the rod 118 slidably fits within each bushing 122, as shown in FIG. 4.

Coupled to each end of the panel support rod 118 is the panel clamp assembly 116, as shown particularly in FIGS. 4 and 5. The panel clamp assembly 116 includes an upper panel clamp 116*a*, a lower panel clamp 116*b*, and clamp fasteners 144 (FIG. 5). The upper panel clamp 116*a* has an L-shaped body 146, upper clamp holes 148 (FIG. 5), and an exterior recess 150 that slopes downward from a top section 152 of the upper panel clamp 116*a*. The exterior recess 150 terminates slightly above the bottom surface of the upper panel clamp 116*a* to form a ridge 154. (See upper panel clamp 116*a* shown in the upper right corner of FIG. 5). The exterior recess 150 and ridge 154 are provided for adjacent positioning of panel clamp assemblies 116, and particularly panel support rods 118, as shown particularly in FIGS. 1 and 2.

The lower panel clamp 116*b* also has an L-shaped body 156. The lower panel clamp 116*b*, however, includes a lower panel clamp portion 158 with a rod receiving hole 160, having a male clamp-rod coupler 162 disposed therein. The male clamp-rod coupler 162 has an outer profile complementary to the inner profile of the slot 142 disposed in the panel support rod 118 such that the rod 118 engages within the coupler 162. The lower panel clamp 116*b* also includes a bottom portion 164, having at least two recessed holes 166 configured to receive clamp fasteners 144 (FIG. 5). When fastened together, each clamp assembly 116 includes a panel receiving slot 170 (See clamp assembly 116 on bottom left corner of FIG. 5) configured to receive end sections 24 of each shield panel 14 (FIG. 4).

When fully assembled, each adjustable bracket assembly 40 provides for both vertical position and angular adjustment of a shield panel 14. Position adjustment of the shield panel 14 is provided by the panel clamp assembly 116 to accommodate shield panels of various sizes and food serving structures of various widths. Position adjustment of an adjustable bracket assembly 40 is provided when assemblies are coupled to posts 16 and/or bridge elements 18 of a shield panel support structure 12. The various elements provided in each bracket assembly 40 lend to the adjustable nature of the food shields, allowing bracket assemblies 40 to be positioned not only upwardly and downwardly, but laterally as well. Moreover, the adjustable bracket assemblies 40 disclosed herein include elements that allow for angular adjustment of shield panels 14/14A further lending to the adjustable nature and aesthetic value of the food shield described herein.

The adjustable bracket assemblies 40R, 40L can be separated from and rejoined to a support post 16 at any location of the support post. Because they are separable into parts, the user does not need to slide the bracket assemblies along a substantial length of a support post 16 to secure the bracket assemblies to a desired location along the support post. The food shields with adjustable bracket assemblies according to the invention thus may be used with any kind of support posts, including support posts 16 as shown, that are contiguous without an open post end.

Referring next to FIGS. 11-15, a side panel 300 with a trapezoidal outer periphery is removably attached to the support structure or post 12. The side panel is not limited to a trapezoid, but may have an outer periphery of any desired design to shield contents held by the food serving structure 200. The side panel 300 may be formed of a suitable material, such as but not limited to, glass, acrylic, and PLEXIGLAS® sheet materials, and particularly sheet materials manufactured for durability within food service environments. Preferably, the side panel 300 is formed of a transparent material to allow food within the food serving structure 200 to be visible to food service workers and persons selecting food from the food serving structure 200. The side panel 300 has a front face 366 and a rear face 368. The side panel 300 may have the same thickness T1 or a different thickness than the food shield panels 23.

Figure 11:
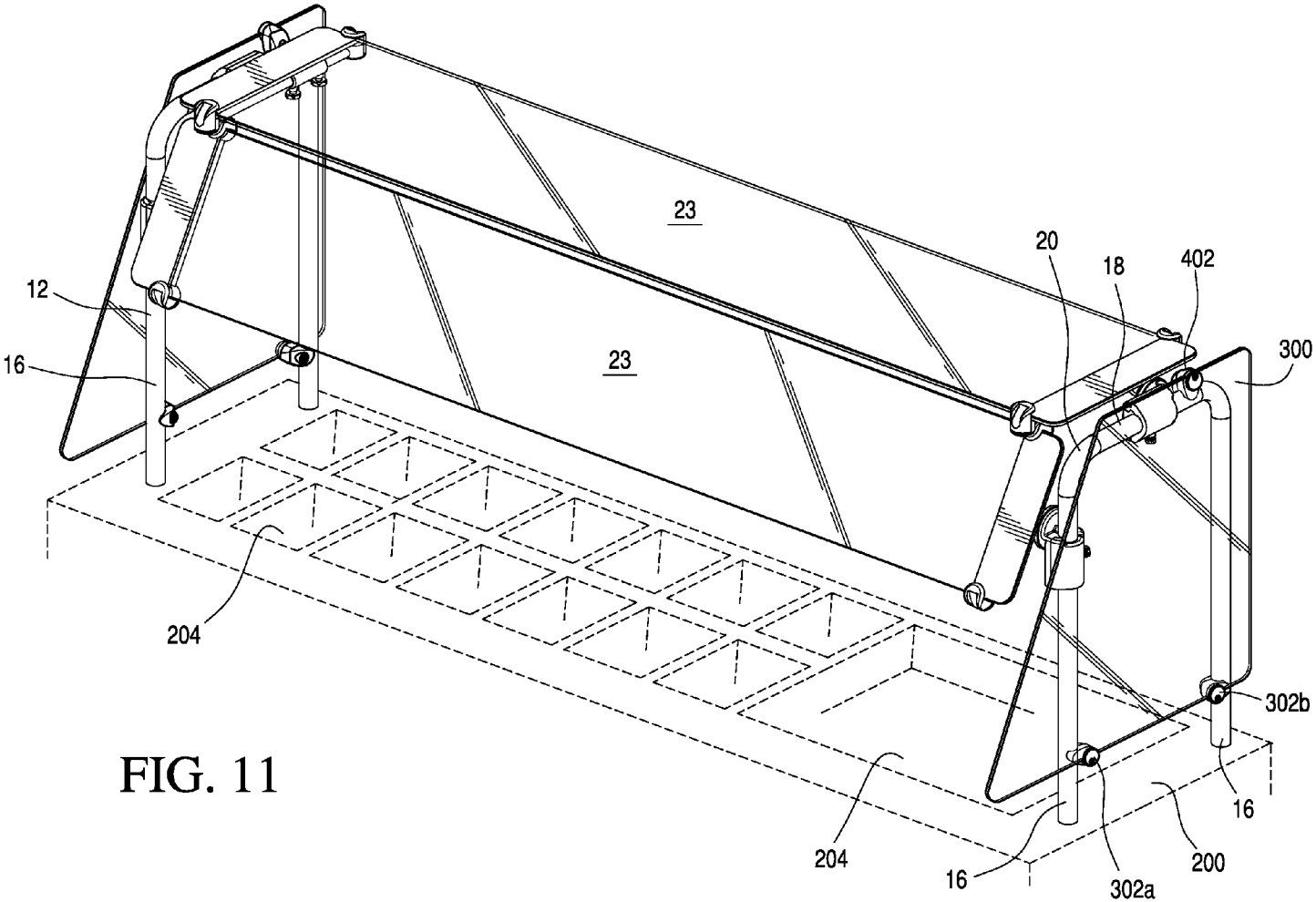
FIG. 11 is a right front perspective view of an alternative embodiment of a food shield with side panels.
Figure 12:
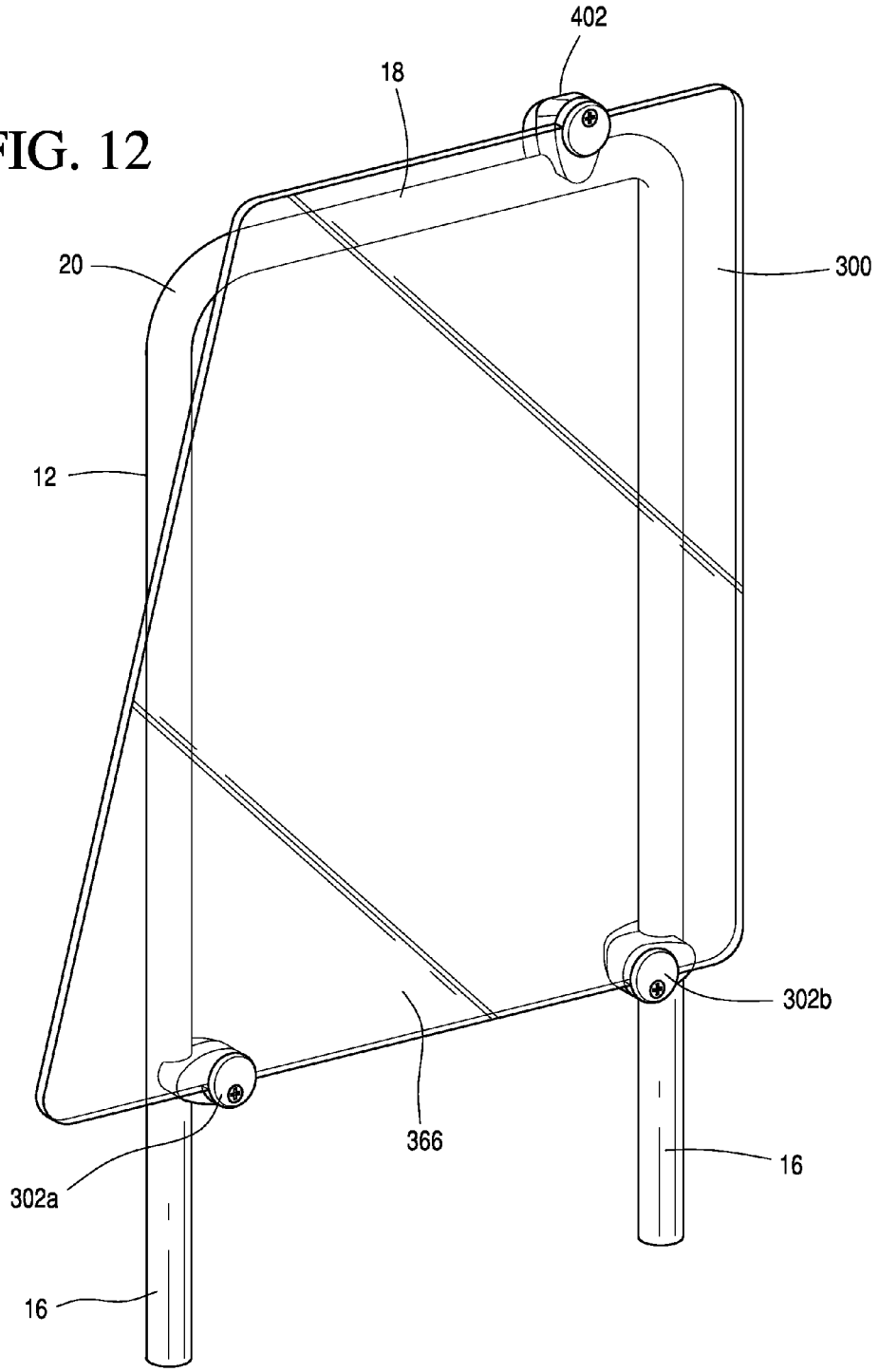
FIG. 12 is a right front perspective view of a side panel engaged to an inverted U-shaped post.
Figure 13:
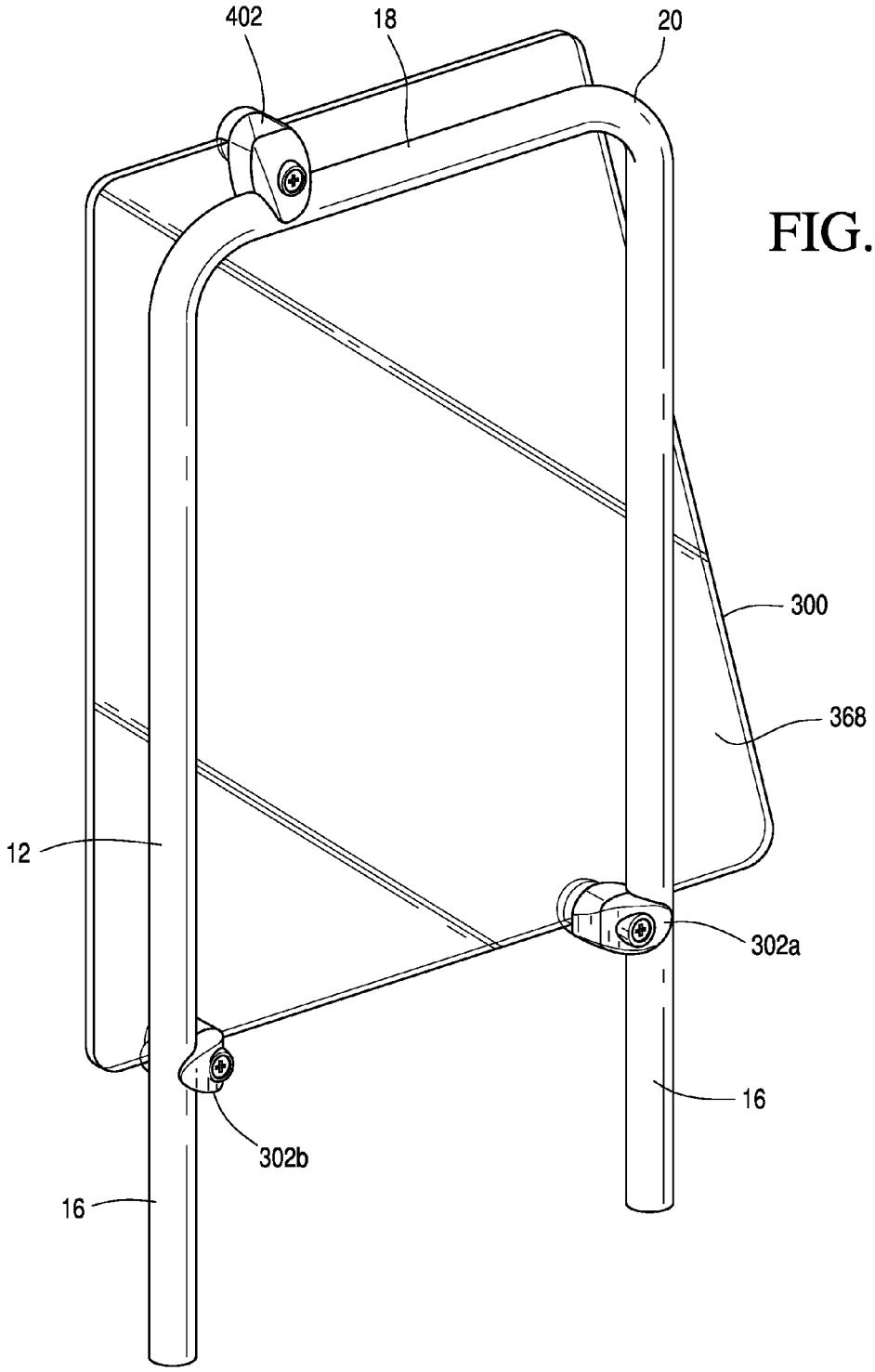
FIG. 13 is a left rear perspective view of the side panel of FIG. 12.

As shown in FIGS. 11-13, the side panel 300 is removably secured to the support structure or post 12 by collar clamps 302, 402. One collar clamp 402 is secured to the top edge of the side panel 300 and to the bridge portion 18 of the inverted U-shaped support post 12. One collar clamp 302*a* is secured to a bottom edge of the side panel 300 and to one of the vertical portions 16 of the inverted U-shaped support post 12. A third collar clamp 302*b* is secured to the bottom edge of the side panel 300 and to the other of the vertical portions 16 of the inverted U-shaped support post 12. Collar clamp 402 alternatively could be secured to the side edge of the side panel 300 and to one of the vertical posts 16 (not shown in FIGS. 11-13).

Figure 14:
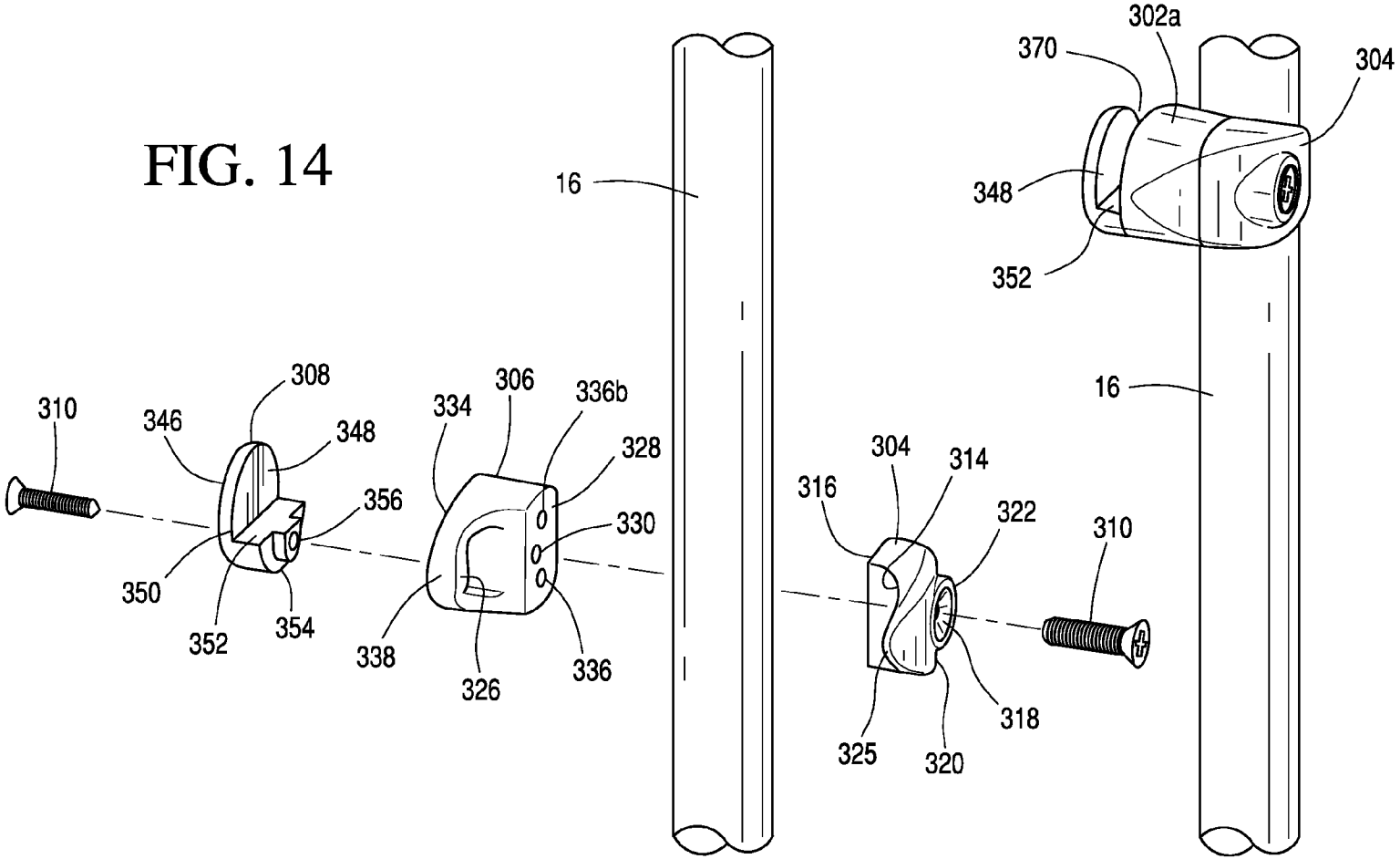
FIG. 14 is an exploded view of a multi-part clamp for attaching a side panel to a vertical post.

Referring now to FIG. 14, the collar clamp 302*a* is shown in exploded view at the left side of the drawing, and as joined to the vertical portion 16 of the post at the left side of the drawing. The collar clamp 302*a* has a first piece 304, a second piece 306 and a third piece 308. The first piece 304 has a curved inner surface 314 of a curvature adapted to match the curve of exterior surface of post 16. The first piece 304 has a flat abutment surface 316 adapted for contact with the second piece 306. A threaded through hole 318 extends through the first piece 314 to engage first fastener 310 such as a screw. The first piece 304 has an exterior surface 320 curved for aesthetic design. In the embodiment shown in FIG. 14, the through hole 318 opens to an upstanding cylindrical wall 322 extending out of the curved exterior surface 320. The exterior surface 320 may terminate in a rounded point at its distal end 325.

The second piece 306 has a curved inner surface 326 of a curvature adapted to match the curve of exterior surface of post 16. The second piece 306 has a flat abutment surface 328 adapted for contact with the flat abutment surface 316 of the first piece 304. A threaded hole or recess 330 is provided in the second piece 306 to engage fastener 310 such as a screw. The second piece 306 has a flat opposite surface 334 intended for contact with rear surface 368 of the side panel 300. An elastomer coating or shim may be applied to or in contact with the flat opposite surface 334. A second threaded hole 336 extends through the second piece 306 to engage second fastener 310 such as a screw, so as to join the third piece 308 to the second piece 306. The second piece 306 may have a curved side face 338 for aesthetic design.

The third piece 308 has an outer face 346 and a side panel contacting face 348 opposite the outer face 346. The third piece 308 has a flat ledge 352 adapted for contact with an edge of side panel 300. The side surface(s) 350 of the third piece are generally curved. The third piece 308 has another face surface 354 spaced apart from the side panel contacting face 348. An elastomer coating or shim may be applied to or in contact with the side panel contacting face 348. A threaded hole 356 is provided in the third piece 308 to engage fastener 310 such as a screw, to join the third piece to the second piece 306 with the face 354 contacting the flat opposite surface 334 of the second piece 306. When joined together by fastener 310, the second piece 306 and the third piece 308 together form a slot for engaging the face surfaces 366, 368 of the side panel 300, with ledge 352 in contact with a side edge of the side panel 300.

Referring to FIG. 14, the right side of the drawing shows the collar clamp 302*a* as assembled and attached to a post 16. First fastener 310 is threadedly engaged into hole 318 and hole 330 to join the first piece 304 to the second piece 306 with curved surfaces in contact with outer surfaces of post 16. Second fastener (not shown in this figure) is threadedly engaged into holes 356 and 336 to join third piece 308 to second piece 306 to abut face 356 to face 334 and establish slot opening 370 between second piece 306 and third piece 308. FIG. 14 does not show side panel held within slot 370.

The same collar clamp components, first piece 304, second piece 306 and third piece 308 can be arranged as shown in FIG. 14 to form collar clamp 302*b*. Alternatively, to form collar clamp 302*b* the first piece 304 and second piece 306 may be rotated by 180 degrees (e.g., inverted) and joined together by fastener 310. Then, third piece 308 may be joined to second piece 306 with second fastener 310 through hole 356 and hole 336*b* hole through second piece 306. The multiple piece collar clamp construction thus permits the same components to be positioned in contact with vertical posts 16 in different orientations by inverting some of the components. The second piece 306 has the extra threaded hole or recess 336*b* to permit connection to the third piece 308 in the alternate configurations.

Figure 15:
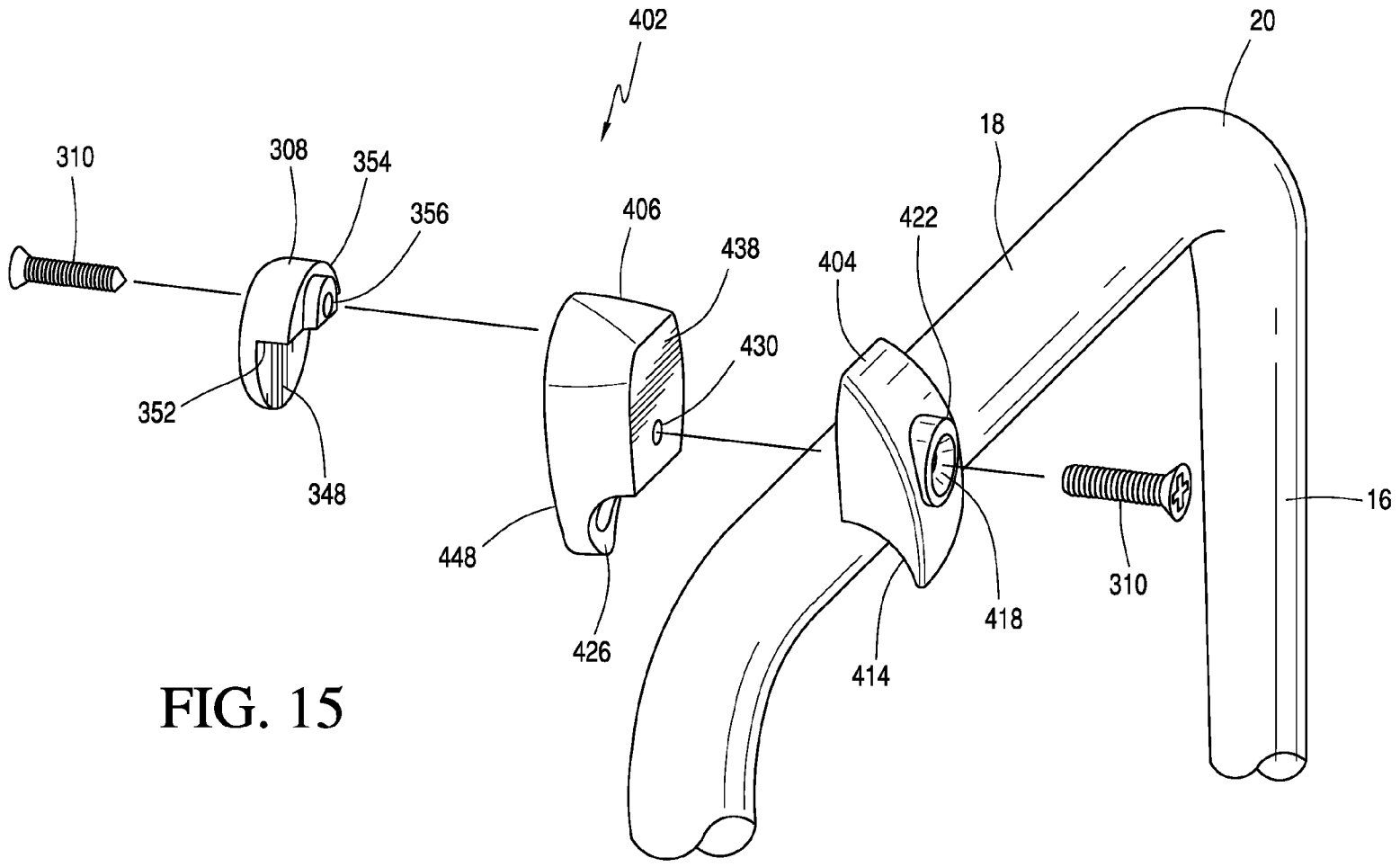
FIG. 15 is an exploded view of a multi-part claim for attaching a side panel to a horizontal post.

Referring to FIG. 15, an alternative collar clamp 402 is shown in exploded view. Some of the same collar clamp components, e.g., third piece 308, can be arranged with alternative first piece 404 and alternative second piece 406 to form collar clamp 402. In this configuration, the fastener 310 threadedly engages the hole 418 and hole 430 to join the first piece 404 to the second piece 406. The second fastener 310 threadedly engages the hole 356 through the third piece 308 and the hole 436 (not shown in FIG. 15) in the second piece 406 to join the third piece 308 to the second piece 406 together and forming a slot between face 448 and face 348. This collar clamp 402 contacts the surface of the side panel 300 with the ledge 352 in contact with the upper edge of the side panel 300 (FIG. 11).

Thus, the collar clamp components (first piece 304, 404 second piece 306, 406 and third piece 308) offer unlimited design flexibility to permit the side panel to be joined to the post 12 with the collar clamps 302*a*, 302*b*, 402 in various locations along the length of the post 12, whether along the vertical posts 16 or bridging portion 18 of the inverted U-shaped post 12. This flexibility ensures that the location adjustable and angularly adjustable shield panels 23 may be oriented as desired and side panels 300 still may be joined to the same support posts 12.

As such, it will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A food shield, comprising:

at least one shield panel adapted to be positioned between two shield panel support structures and adapted for coupling to the two shield panel support structures;

a first adjustable bracket assembly adapted for coupling to at least one post of one of the shield panel support structures, wherein said first adjustable bracket assembly provides location and angular adjustment of the shield panel in respect to the at least one post;

a second adjustable bracket assembly adapted for coupling to at least one post of the other of the shield panel support structures, wherein said second adjustable bracket assembly provides location and angular adjustment of the shield panel in respect to the at least one post of the other shield panel support structures; and a side panel having a first face surface and an opposite face surface, a top edge and a bottom edge, said side panel joined to the at least one post of one of the shield panel support structures in a substantially vertical orientation with post-engaging collar clamps, with each collar clamp defining a slot with slot faces that engage the first face surface and opposite face surface of the side panel near an edge thereof with sufficient clamping force to maintain the side panel in fixed position, and with curved inner surfaces that engage around more than one-half of the circumference of the post, wherein the post is an inverted U shape, and the first collar clamp is disposed at the bottom edge of the side panel and engages one vertically disposed portion of the post, the second collar clamp is disposed at the bottom edge of the side panel and engages another vertically disposed portion of the post, and the third collar clamp is disposed at the top edge of the side panel and engages a horizontally disposed portion of the post.

2. The food shield of claim 1, wherein each collar clamp has a first piece which defines a first of the curved inner surfaces and a second piece which defines a second of the curved inner surfaces, and the first piece and second piece are joined together with at least one fastener.

3. The food shield of claim 2, wherein the first piece defines an internally threaded through hole and the second piece defines an internally threaded hole or recess, and the at least one fastener is a screw that mates with the threaded hole(s) and/or recess.

4. The food shield of claim 2, wherein each collar clamp has a third piece that is joined to the second piece to define the slot to engage the first face surface and opposite face surface of the side panel.

5. The food shield of claim 4, wherein the third piece defines an internally threaded through hole and the second piece defines a first internally threaded hole or recess, and the third piece is joined to the second piece with at least one other fastener threadedly engaged with the threaded through hole of the third piece and the threaded hole of the second piece.

6. The food shield of claim 5, wherein the second piece defines a second internally threaded through hole or recess spaced apart from the first internally threaded hole or recess, such that the at least one other fastener may threadedly engage with the threaded through hole of the third piece and either the first threaded hole or recess or second threaded hole or recess of the second piece.

7. The food shield of claim 1, wherein the post-engaging collar clamps for the side panel are disposed at different locations along the post from mounting locations for the first adjustable bracket assembly.

8. The food shield of claim 1, wherein the side panel has a non-rectangular outer periphery.

9. The food shield of claim 4, wherein the first piece defines an internally threaded through hole, the second piece defines two or more internally threaded holes or recesses and the third piece defines an internally threaded through hole, and wherein a first fastener engages the first piece to the second piece and a second fastener engages the third piece to the second piece.

10. The food shield of claim 4, wherein the second piece is interchangeably fastened to the third piece at different orientations by inverting or rotating the second piece with respect to the third piece.

* * * * *